United States Patent [19]

Proffer

[11] 4,376,591

[45] * Mar. 15, 1983

[54] CONTAINER CAP WITH NECK ABUTTING RETRACTABLE LIQUID PICKUP STRUCTURE

[76] Inventor: Charles L. Proffer, #11 53rd Street Cir., Gulfport, Miss. 39501

[ * ] Notice: The portion of the term of this patent subsequent to Feb. 2, 1992, has been disclaimed.

[21] Appl. No.: 204,068

[22] Filed: Nov. 4, 1980

Related U.S. Application Data

[63] Continuation-in-part of Ser. No. 118,569, Feb. 4, 1980, Pat. No. 4,313,686.

[51] Int. Cl.[3] ..... B65B 3/04

[52] U.S. Cl. ..... 401/127; 141/24; 401/119

[58] Field of Search ..... 401/118, 119, 121, 122, 401/126, 127, 128, 129, 130; 141/24; 128/233

[56] References Cited

U.S. PATENT DOCUMENTS

| | | | |
|---|---|---|---|
| 562,134 | 6/1896 | Haner | 401/127 X |
| 856,496 | 6/1907 | Smith | 401/127 |
| 1,117,863 | 11/1914 | Larson | 401/127 |
| 2,538,447 | 1/1951 | Finney | 401/127 |
| 2,756,749 | 7/1956 | Munday | 141/24 |
| 3,337,901 | | Schefer et al. | 401/129 |
| 3,881,527 | 5/1975 | Shapiro | 141/24 |
| 4,313,686 | 2/1982 | Proffer | 401/127 |

FOREIGN PATENT DOCUMENTS

| | | | |
|---|---|---|---|
| 324879 | 12/1929 | Fed. Rep. of Germany | 401/118 |
| 101022 | 3/1941 | Sweden | 401/129 |
| 442641 | 1/1968 | Switzerland | 401/127 |
| 411048 | 5/1934 | United Kingdom | 401/127 |

*Primary Examiner*—Steven A. Bratlie
*Attorney, Agent, or Firm*—Harvey B. Jacobson

[57] ABSTRACT

A screw cap for a container equipped with a threaded neck is provided and the cap supports a liquid pickup tube therefrom having a squeeze bulb communicated with its upper end and with the pickup tube mounted from the cap for limited axial shifting and rotation relative to the cap. The pickup tube is spring biased to a position of maximum extension relative to the open end of the cap and is equipped with an abutment disk for abutting the outer end of the associated container threaded neck to retract the pickup tube in response to threaded engagement of the cap with the container neck. The pickup tube is of a length to extend to the bottom of the container when the disk is abutted against the outer end of the container neck and the pickup tube r be extended relative to the cap to a position with the abutment disk disposed slightly outward of the open end of the cap when the cap is disengaged from the container neck.

5 Claims, 2 Drawing Figures

CONTAINER CAP WITH NECK ABUTTING RETRACTABLE LIQUID PICKUP STRUCTURE

CROSS-REFERENCE TO RELATED APPLICATION

This application is a continuation-in-part of my copending application Ser. No. 118,569, filed Feb. 4, 1980, for Container Cap with Neck Abutting Retractable Applicator, now U.S. Pat. No. 4,313,686, dated Feb. 2, 1982.

BACKGROUND OF THE INVENTION

Various liquid materials are marketed in containers equipped with threaded closure caps having elongated squeeze bulb equipped pickup tubes supported therefrom and most of these pickup tubes extend to the bottom of the interior of the container when the cap is fully threaded on the neck of the container. However, when the cap is not threadedly engaged with the neck of the container, but merely abutted against the outer end thereof, the pickup tube is not sufficiently long to reach to the bottom of the associated container. Accordingly, in order to position the pickup tube of a pickup tube equipped cap sufficiently into an associated container to reach the last bit of liquid within the container upon the latter having its contents almost completely depleted, it is necessary to screw the cap onto the neck of the container each time the pickup tube is to contact the liquid within the container. This, of course, is time consuming.

In addition, although container caps heretofore have been provided with reciprocally supported applicator shanks such as that disclosed in U.S. Pat. No. 3,337,901, and a squeeze bulb equipped pickup tube could be similarly mounted, these reciprocal applicator shanks and a similar pickup tube, while accomplishing the desired effect of enabling the applicator shank and the pickup tube to withdraw the final amount of liquid from the bottom of an associated container, include generally radially outwardly projecting abutment disks carried thereby for abutting engagement with the outer ends of the associated container necks and the abutment disks are subject to being bonded to the outer end of the container necks by the drying of liquid materials thereon from within the associated containers. Accordingly, a need exists for a container cap reciprocally supported squeeze bulb equipped pickup tube including structure, whereby any bonding of the container neck abutting disk on the container neck outer end may be freed upon initial loosening of the container cap.

The main object of this invention is to provide a screw cap for a container including a reciprocally supported squeeze bulb equipped pickup tube which may extend down to the bottom of the interior of the container both when the cap is screwed on a threaded neck of the container and when the cap is abutted against the outer end of the container neck, but with the pickup tube and cap including coacting structure releasably keying the pickup tube, and thus the disk of the pickup tube, to the cap for rotation therewith while loosening the cap from a thightened position on the neck of the associated container.

A final object of this invention to be specifically enumerated herein is to provide a combined container and cap construction in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
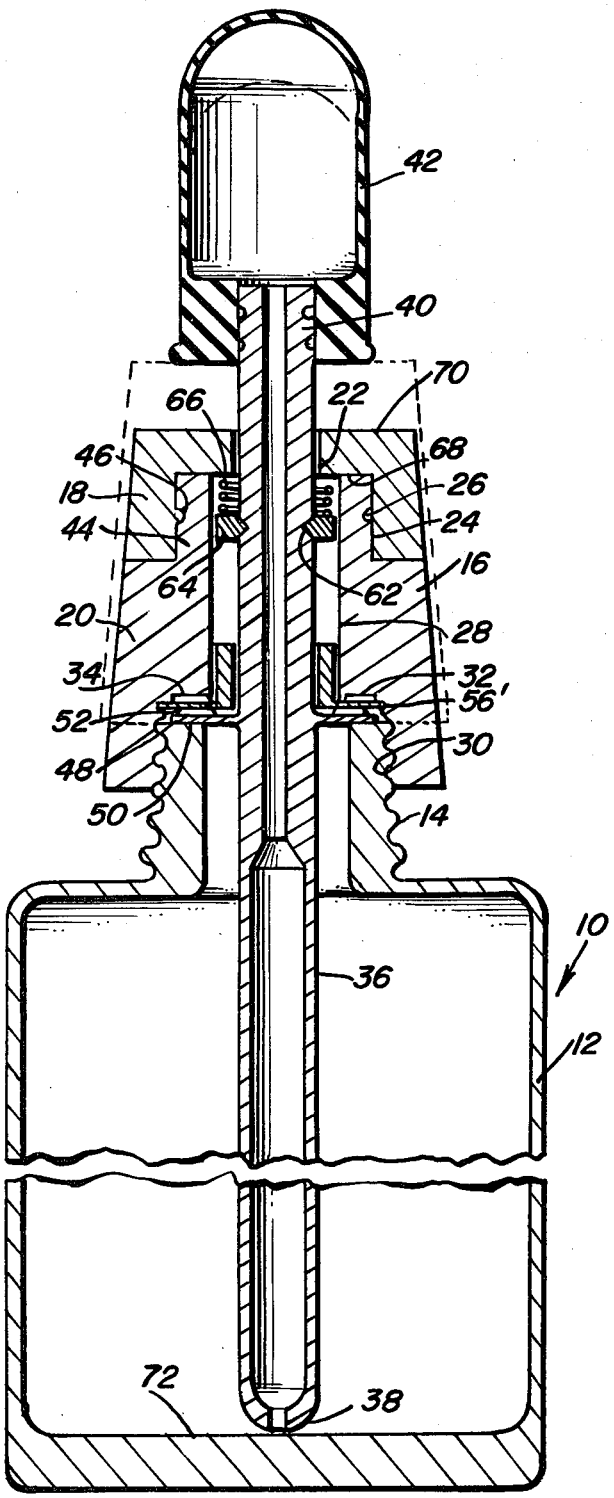
FIG. 1 is a central vertical sectional view taken substantially upon a plane passing through the center of the closure cap and an associated container combination constructed in accordance with the present invention and with the closure cap in a fully closed position, an alternate open position of the container cap being illustrated in phantom lines.
Figure 2:
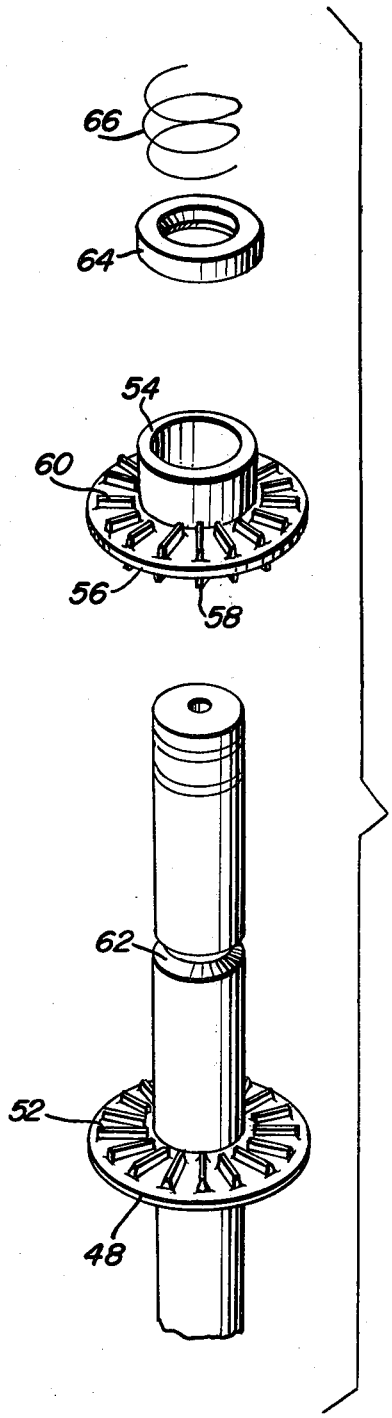
FIG. 2 is a fragmentary exploded perspective view of the pickup tube portion of the container cap.

Referring now more specifically to the drawings, the numeral 10 generally designates a container and cap combination including a container 12 equipped with an externally threaded neck 14 and a cap or cap body 16 incorporating interfitted upper and lower components 18 and 20.

The upper component 18 includes a vertical bore 22 formed therethrough and the lower end of the bore 22 includes a diametrically enlarged counterbore 24. The counterbore 24 includes a mid-height circumferential rib 26.

The lower component 20 includes a vertical bore 28 formed therethrough including a diametrically enlarged lower end threaded counterbore or recess 30. The lower component 20 defines a downwardly facing shoulder 32 at the upper end of the counterbore 30, the shoulder 32 including circumferentially spaced radial grooves or recesses 34 formed therein.

An elongated vertically disposed dispenser shank or pickup tube 36 is provided and includes a lower inlet end 38 and an upper end 40 upon which a squeeze bulb 42 is mounted. The pickup tube 36 is slidingly and rotatably received through the bore 22 and the bore 28 and the lower component 20 of the cap 16 includes an upwardly projecting shank portion 44 equipped with a circumferential mid-height groove 46. The shank portion 44 is snapped fittingly engaged within the counterbore 24 with the rib 26 seated in the groove 46. Accordingly, the upper and lower components 18 and 20 of the cap 16 are securely fastened together.

The pickup tube 36 includes an integral abutment disk 48 thereon for abuttingly engaging the upper smooth end face 50 of the neck 14. The upper surface of the abutment disk 48 includes circumferentially spaced and radially projecting ribs 52 and a sleeve 54 is slidably disposed on the pickup tube 36 above the abutment disk 48. The sleeve 54 includes an abutment disk 56 carried by the lower end thereof and the underside of the abutment disk 56 includes circumferentially spaced and radially extending ribs 58, while the upper surface of the abutment disk 56 includes similar circumferentially spaced and radially extending ribs 60. The outer periphery of the disk 56 is snap fitted in a circumferential groove 56' defined at the upper end of counterbore 30. The ribs 60 are seatingly engageable in the grooves or recesses 34 and the ribs 58 are seatingly receivable between the ribs 52 on the abutment disk 48. Accordingly, when the cap 16 is downwardly threaded into tightened closed position on the neck 14, the abutment disk 48 is tightly abutted against and sealed relative to the upper end face 50 of the neck 14. However, the ribs 52 are keyed between the ribs 58 and the ribs 60 are keyed in the grooves or recesses 34. Accordingly, the pickup tube and abutment disk 48 are thus keyed to the cap 16 for rotation therewith. Therefore, when the cap 16 is loosened from a fully tightened position, the disk 48 is caused to rotate relative to the upper end face 50 in order to break any adhesive bond existing between the disk 48 and the upper end face 50 of the neck 14.

In addition, the pickup tube 36 includes a circumferential groove 62 spaced above the abutment disk 48 and in which a snap ring 64 is seated. A compression spring 66 is disposed about the pickup tube 36 above the snap ring 64 and below the downwardly facing shoulder 68 defined in the upper component 18 of the cap 16 at the upper limit of the counterbore 24. Thus, the compression spring 66 downwardly biases the pickup tube 36 to a position with the lower end of the squeeze bulb 42 abuttingly engaged with the upper end face 70 of the upper component 18 of the cap 16. When the pickup tube 36 is thus downwardly extended relative to the cap 16 and the lower end thread in the counterbore 30 is abutted with the upper end thread on the neck 14, the lower end 38 of the pickup tube 36 is abutted against the bottom 72 of the container 12. Thus, the lower end of the pickup tube 36 may be abutted against the bottom 72 when the cap is engaged with the upper end of the neck 14, only. Accordingly, all of the liquid contents of the container 12 may be drawn up into the pickup tube 36 by manipulation of the squeeze bulb 42.

On the other hand, when it is desired to reclose the cap 16, the cap 16 may be threaded downward on the neck 14 to the fully closed position thereof illustrated in FIG. 1 of the drawings while the pickup tube 36 remains vertically stationary. Of course, as the cap 16 approaches its final closed position, the disk 48 and tube 36 are keyed to the cap 16 for rotation therewith and any fluid substance on the upper end face 50 of the neck 14 tends to be wiped therefrom by rotation of the disk 48 relative to the neck 14 during final threaded movement of the cap 16 to its fully closed position. Thus, the tendency of an adhesive bond to form between the abutment disk 48 and the upper end of the neck 14 is reduced. Further, upon subsequent loosening of the cap 16 relative to the neck 14, initial rotation of the cap 16 relative to the neck 14 will cause rotation of the disk 48 relative to the neck 14 and thus any slight adhesive bond which has occurred to be broken.

There is, of course, to be noted that the cap 16 is of two-piece construction in order to facilitate initial assembly of the various components of the cap 16 and the pickup tube as well as the other components supported from the pickup tube.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A cap and dispenser combination for reaching substantially completely to the bottom of the interior of an associated container, said combination including a cap body defining a first downwardly opening lower threaded recess therein for threadedly receiving a threaded container neck, an elongated upstanding dispenser shank including liquid pickup structure on its lower end, said dispenser shank being supported from said cap body for longitudinal shifting relative thereto between upper and lower limit positions and for rotation about its longitudinal center axis relative to said cap body with said dispenser shank generally centered in and projecting outwardly of said lower threaded recess, said dispenser shank and cap body including coacting means operable to releasably key said dispenser shank to said cap body against rotation of said dispenser shank relative to said cap body responsive to longitudinal shifting of said dispenser shank from its lower limit position toward its upper limit position, said dispenser shank including a radially outwardly projecting abutment disk carried thereby for abutting with the outer end of a threaded container neck, means operatively connected between said dispenser shank and cap body yieldingly biasing said shank toward its lower limit position relative to said cap body, said cap body defining an inwardly projecting generally radial annular shoulder at the inner end of said threaded recess, said coacting means including a sleeve loosely, slidably and rotatably received on said shank above said abutment disk and including a second radially outwardly projecting abutment disk loosely received in said threaded recess above the first mentioned disk, the upper and lower surfaces of said second abutment disk and said shoulder and the upper surface of the first mentioned abutment disk including coacting generally radial projection and recess portions engageable with each other axially of said dispenser shank.

2. The combination of claim 1 wherein said dispenser shank comprises a hollow liquid pickup tube and the upper end of said tube projects through and above said cap body and is equipped with a squeeze bulb.

3. The combination of claim 1 wherein said cap body includes upper and lower components, said upper component having an upstanding bore formed therethrough including a diametrically enlarged counterbore on its lower end, said lower component having a second upstanding bore formed therethrough including a diametrically enlarged counterbore at the lower end thereof, said lower component including an upwardly projecting central shank portion seatingly received in the first mentioned counterbore, said dispenser shank comprising a hollow liquid pickup tube and the upper end of said pickup tube projecting through and above said cap body and being equipped with a squeeze bulb, said pickup tube passing through said bores.

4. The combination of claim 3 wherein the second upstanding bore is larger in diameter than the first mentioned bore, said tube including an upwardly facing abutment thereon disposed in the second upstanding bore, said means connected between said dispenser shank and cap body including a compression spring disposed about said tube between said abutment and the inner extremity of the first mentioned counterbore.

5. The combination of claim 1 wherein said first mentioned abutment disk is upwardly receivable in said downwardly opening lower threaded recess upon movement of said dispenser shank to its upper limit position relative to said cap body.

* * * * *